US006264403B1

(12) United States Patent
Hall et al.

(10) Patent No.: US 6,264,403 B1
(45) Date of Patent: Jul. 24, 2001

(54) PILE AND METHOD OF DRIVING A PILE

(75) Inventors: Robert S. Hall, Washwater; David J. Hall, Upottery, both of (GB)

(73) Assignee: Target Fixings Limited, Crowthorne (GB)

( * ) Notice: Subject to any disclaimer, the term of this patent is extended or adjusted under 35 U.S.C. 154(b) by 0 days.

(21) Appl. No.: 09/351,589

(22) Filed: Jul. 12, 1999

(30) Foreign Application Priority Data

| | | |
|---|---|---|
| Jan. 14, 1997 | (GB) | 9700607 |
| Oct. 17, 1997 | (GB) | 9722039 |
| Jan. 12, 1998 | (WO) | PCT/GB98/00082 |

(51) Int. Cl.[7] ..... E02D 5/56

(52) U.S. Cl. ..... 405/252.1; 405/232; 405/231; 405/254

(58) Field of Search ..... 52/157; 405/229, 405/230, 231, 232, 244, 249, 250, 251, 252.1, 253, 254

(56) References Cited

U.S. PATENT DOCUMENTS

| | | | | |
|---|---|---|---|---|
| 226,664 | * | 4/1880 | Kirkup | 405/254 |
| 683,275 | * | 9/1901 | Hartung | 405/254 |
| 2,332,990 | | 10/1943 | Collins | 61/53 |
| 4,650,372 | * | 3/1987 | Gorrell | 405/232 |
| 4,911,581 | | 3/1990 | Mauch | 405/232 |

FOREIGN PATENT DOCUMENTS

| | | | | |
|---|---|---|---|---|
| 0246589 | | 11/1987 | (EP) . | |
| 86047 | * | 8/1957 | (NL) | 405/253 |
| 1645368 | * | 4/1991 | (SU) | 405/252.1 |
| 9830757 | | 7/1998 | (WO) . | |

* cited by examiner

*Primary Examiner*—David Bagnell
*Assistant Examiner*—Frederick L. Lagman
(74) *Attorney, Agent, or Firm*—Conley, Rose & Tayon, P.C.

(57) ABSTRACT

A pile (1) has a plurality of external parallel helical fins (30,31,32) along substantially the whole length of the pile (1). At least one of the fins (30,31,32) has a wedge-shape cross-section. The pile (1) can be driven into a substrate by applying a force to the pile (1) substantially parallel to the longitudinal axis (2) of the pile (1), the force having substantially no rotational component about the longitudinal axis (2). The helical fins (30,31,32) on the pile (1) cause the pile (1) to rotate in the substrate and thereby penetrate the substrate as the force is applied.

19 Claims, 5 Drawing Sheets

Graph Showing How Angle of Fins Varies with Pitch Lengths for Different Pile Diameters

PILE AND METHOD OF DRIVING A PILE

RELATED APPLICATIONS

This is a continuing application of pending PCT Application No. PCT/GB98/00082 which claims priority from GB9700607.6 filed Jan. 14, 1997 and GB9722039.6 filed Oct. 17, 1997.

The present invention relates to a pile and a method of driving a pile.

A pile is an elongate rod, often of reinforced concrete with a steel sleeve or similar material or of solid steel, which is used in construction to provide a foundation or support for buildings or as an anchor for many different applications. Various designs of pile are known.

A first type of known pile is simply a smooth elongate rod which may have a sharpened tip. This type of pile is driven into the ground by simple hammering on the non-sharp end to drive the pile into the ground.

Another type of pile is a so called screw pile, an example of which is shown in SU-A-1035133. The pile disclosed in this patent application is hollow and has a spiral blade on its external surface. A screw-threaded drive shaft is threaded into a nut which is fixed inside the pile. The exposed end of the drive shaft is struck with a hammer which, through the action of the screw thread on the drive shaft and the nut fixed inside the pile, causes the pile to rotate and thus drive itself into the ground by virtue of the spiral blade. However, this construction is relatively complex and expensive to manufacture and maintain.

U.S. Pat. No. 4,650,372 discloses a screw pile having two parallel helical flanges at its lowermost end only, each of which completes half a turn around the core of the pile. The helical flanges are ribbon-like and the lowermost edges of the helical flanges are bevelled. Conventional pile-driving equipment is used to drive the pile into the ground.

EP-A-0246589 discloses several piles having different constructions. In one construction, a single wedge-shape helical thread is provided along substantially the whole length of the pile. In another construction, two parallel helical threads are provided along the length of the pile, each thread having a convex external surface provided by an arcuate cross-sectional shape of the thread.

EP-A-0574057 discloses a screw pile having a single helical thread along its length.

EP-A-0311363 discloses a screw pile having a single helical thread along a part of its length.

Each of the prior art piles is unsatisfactory, for various reasons. For example, such piles are difficult to drive into a substrate, do not provide adequate load-bearing, do not adequately resist heave (i.e. upward movement of the substrate) and/or are large. Because conventional piles typically rely on friction between the surface of the pile and the substrate to resist heave, the conventional piles are long (typically 6 to 8 or 9 meters long) and wide (typically having an outside diameter of 150 to 300 mm) and are therefore heavy and difficult to handle and manipulate. Furthermore, because heave typically arises in the top meter or so of the substrate and therefore tends to act on the topmost portion of the pile only, conventional piles are often provided with a sleeve around the top 1 to 3 meters of the pile to prevent movement of the upper layer of the substrate tending to lift the pile. The addition of such a sleeve increases the installation time and costs. Furthermore, the downwards load-bearing ability of conventional piles is at least in part provided by the friction between the surface of the pile and the substrate, a requirement which again leads to conventional piles being relatively long and wide. Where a screw thread is provided only on a lowermost portion of a pile as in some prior piles, the screw thread has been found to loosen the soil or other substrate as the pile is screwed into the ground, reducing the ability of the plain portion of the pile above the screw thread to have good contact with that loosened soil, thereby in turn reducing the upwards and downwards load-bearing capabilities of the pile.

Accordingly, there is a need for an improved pile and method of driving a pile.

According to a first aspect of the present invention, there is provided a pile, the pile having a plurality of external helical fins along substantially the whole length of the pile, at least one of the fins having a wedge-shape cross-section.

It will be understood that the helical fins should extend along the whole of the load-bearing portion of the pile, i.e. that portion which is buried in a substrate in use; the fins need not extend to the uppermost portion (say the top few centimeters) of the pile, for example, which may be left blank to allow fixings for the pile to be fitted.

The fins are preferably substantially parallel.

In a most preferred embodiment, the pile has three external helical fins along substantially the whole length of the pile. The provision of three fins ensures that the pile screws into the substrate evenly without misalignment and ensures symmetrical load-bearing capability around the pile. Three fins also serve to prevent the pile bending as it is forced into a substrate.

The fins are preferably substantially identical.

The pitch of each fin may be in the range 100 mm to 500 mm.

The height of each fin may be in the range 10 mm to 50 mm.

The outside diameter of the pile may be in the range 25 mm to 150 mm.

Each fin may be hollow. The or each fin may be filled with a filling material.

Preferably, however, each fin is solid.

The pile may be hollow. The pile maybe filled with a filling material.

Preferably, however, the pile is solid.

According to a second aspect of the present invention, there is provided a method of driving a pile as described above into a substrate, the method comprising the step of applying a force to said pile substantially parallel to said longitudinal axis, said force having substantially no rotational component about the longitudinal axis, the helical fins on said pile causing said pile to rotate in the substrate and thereby penetrate the substrate as said force is applied.

The force may be applied repeatedly as a series of impulses to the pile. Thus, a repeated hammer-type action can be used to drive the pile.

A pilot hole may be formed in the substrate prior to driving the pile into the substrate.

An end of the pile may be allowed to protrude from the substrate after driving of the pile is complete, and the method may include the further step of fixing the protruding end against rotation relative to the substrate. The end may be fixed in concrete, for example.

The pile may be provided as plural sections. A first section may be driven into the substrate, a second section connected thereto, and a force then applied to the second section to drive said connected sections into the substrate. This may be repeated for third and further sections.

The present invention allows a pile to be screwed into a substrate such as the ground by simple application of a hammer-type force to the pile in a direction substantially parallel to the longitudinal axis of the pile. It is not necessary to provide a complex screw-driving mechanism for driving the pile, either in the pile itself or in the machine which provides the driving force. Manual application of a torque to screw the pile into the substrate is not required. The pile may be short and narrow compared to conventional piles and therefore is much easier to handle. The load-bearing capabilities and resistance to heave of the pile are greatly improved compared to conventional piles.

Embodiments of the present invention will now be described by way of example with reference to the accompanying drawings, in which.

Figure 1:
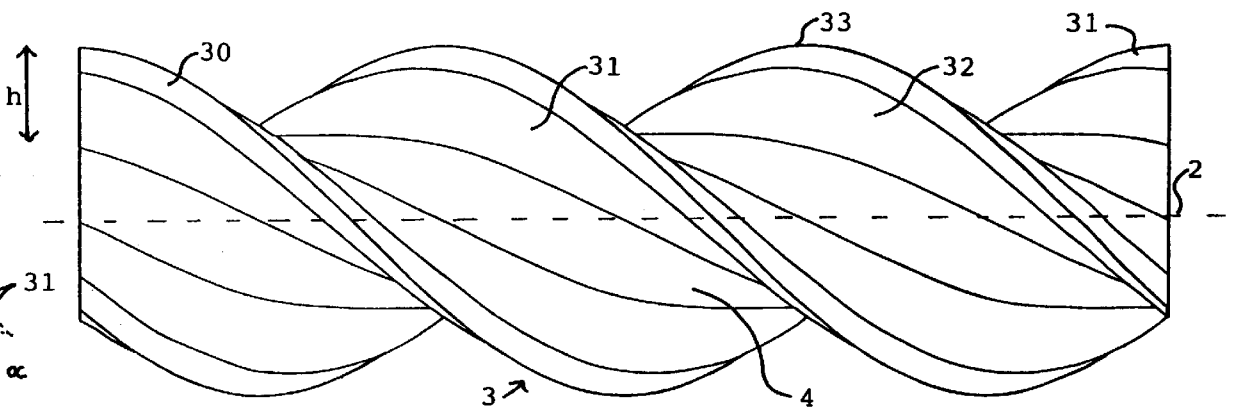
FIG. 1 is an elevation of an example of a pile.

Referring to the drawings, a pile 1 is elongate and has a central longitudinal axis 2. The pile 1 has a helical screw thread 3 on its external surface. The thread 3 is shown as being a right handed thread in the drawings though a left handed thread may be used instead. In the example shown in the drawings, the pile 1 has a central cylindrical core 4 of circular cross-section.

The helical thread 3 is provided by three parallel and evenly spaced helical fins 30,31,32 on the core 4 which run along the whole length of the pile 1 in the example shown. The fins 30,31,32 have a wedge-shape cross-section which will be discussed further below. It will be understood that the fins 30,31,32 should extend along the whole of the load-bearing portion of the pile 1, i.e. that portion which is buried in a substrate in use. The fins 30,31,32 need not in fact extend to the uppermost portion (say the top few centimeters) of the pile 1, for example, which may be left blank to allow fixings for the pile 1 to be fitted. The provision of three fins 30,31,32 ensures that the pile 1 screws into the substrate evenly without misalignment and ensures symmetrical load-bearing capability around the pile 1. Three fins 30,31,32 also serve to prevent the pile 1 bending as it is forced into a substrate. The wedge-shape of the fins 30,31,32 makes the fins 30,31,32 strong and resist to breakage. The angle at the apex of the fins 30,31,32 may be in the range 15 to 75 and is 60 in the preferred embodiment.

Figure 2:
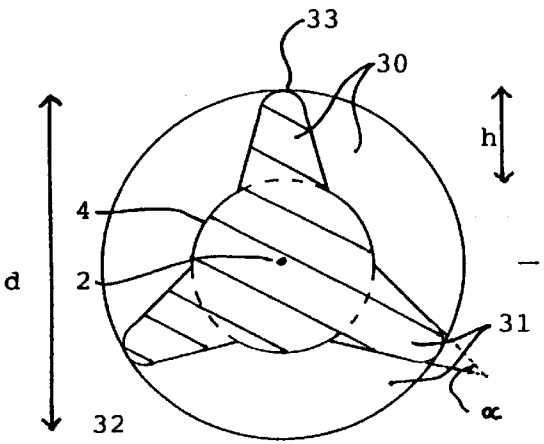
FIG. 2 is a cross-sectional view of the pile of FIG. 1.

The core 4 and fins 30,31,32 are preferably integral and are preferably solid as shown in FIGS. 1 and 2. The core 4 and fins 30,31,32 may be made from a corrosion-resistant material. Suitable materials include stainless steel, brass, copper, aluminium, resin, glass fiber, plastics or carbon fiber. Glass or carbon fibre-reinforced plastics may also be used, for example.

Alternatively, the core 4 and fins 30,31,32 may be initially formed separately and then joined by any suitable method such as welding.

The core 4 may be hollow. A hollow core 4 may be filled with a suitable filling material such as cementitious grout, resin, glass fibres plastics, carbon fibre, or carbon fibre-reinforced plastics or glass fibre-reinforced plastics.

The fins 30,31,32 may similarly be hollow and optionally filled with a filling material such as cementitious grout, resin, glass fibre, plastics, carbon fibre, or carbon fibre- or glass fibre-reinforced plastics.

A solid core 4 may be made of mild steel, stainless steel, resin, glass fibre, carbon fibre, plastics, or glass fibre or carbon fibre-reinforced plastics, for example.

Whilst three helical fins 30,31,32 are shown in the drawings, the number of fins may be varied. For example, there may be any number from two to six parallel helical fins on the pile 1.

Figure 3:
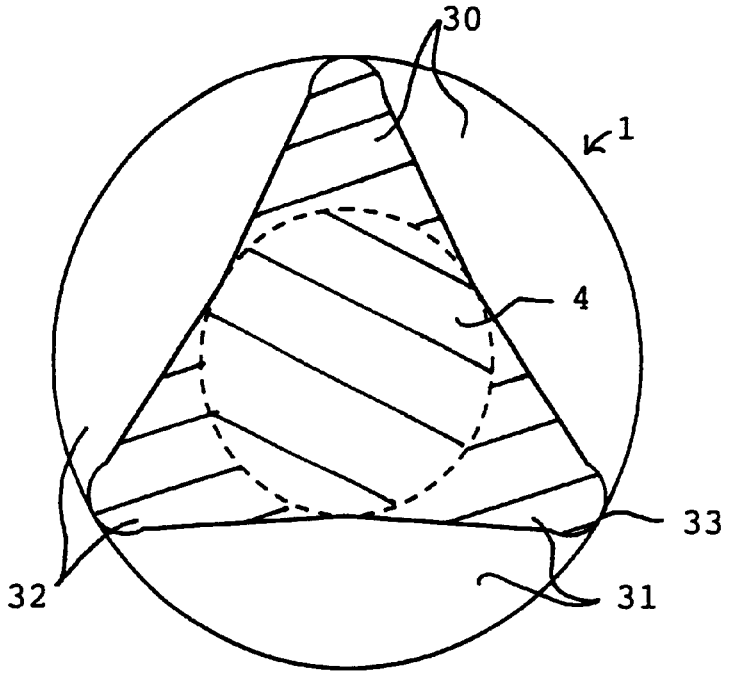
FIGS. 3 and 4 are cross-sectional view of examples of piles having different cross-sectional shapes for the fins.
Figure 4:
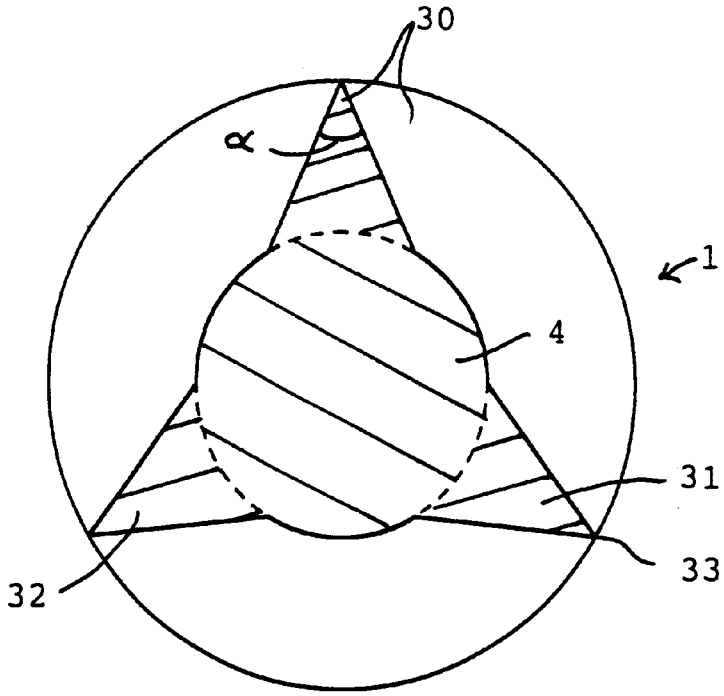

The fins 30,31,32 of the example shown in FIGS. 1 and 2 are generally triangular in section with rounded leading edges 33. In the example shown in FIG. 3, the fins 30,31,32 are again triangular with rounded leading edges 33 in cross-section, but the bases of the triangles are wider in this example so that the respective bases of the fins 30,31,32 touch at the surface of the core 4 as shown. In the example shown in FIG. 4, the fins 30,31,32 have a triangular cross-sectional shape and have a sharp angular leading edge 33 instead of a rounded leading edge. Whilst the fins 30,31,32 of each of the examples of the pile 1 have straight sides, the wedge-shape fins 30,31,32 may have slightly rounded sides and therefore may have a bulging triangular cross-sectional shape.

The pile 1 is conveniently manufactured by an extrusion or pultrusion method, a pultrusion method being one in which the material is pulled through the die rather than pushed through the die as in extrusion. The extrusion or pultrusion method may be used to form hollow or solid tubular sections. In order to provide the helical thread 3, the die may twist as the material is pushed or pulled through the die or the material may be pulled and twisted through a stationary die. A combination of twisting of the die and the material may also be used.

If a hollow core 4 or hollow fins 30,31,32 are used, and the hollow core and/or fins are to be filled with a filling material as mentioned above, this filling material may be included in the extrusion or pultrusion process. Alternatively, a filling material may be introduced into a formed hollow pile 1 after extrusion or pultrusion has been completed.

The pile 1 may alternatively be moulded or cast into the appropriate shape.

The ends of the pile 1 may be threaded or provided with some other means by which short sections of pile 1 can be connected together as will be discussed further below.

The precise dimensions of the pile 1 may be determined according to the material from which the pile 1 is made and also according to the intended application for the pile 1. The overall diameter d of the pile 1 may be between 25 and 150 mm for example. In a preferred embodiment, the outside diameter d of the pile 1 is 60 mm. The pitch of each helical fin 30,31,32 may be in the range 100 and 500 mm. Each fin 30,31,32 may protrude by a height h from the surface 4 of the core 4 where h may be between 10 and 50 mm. The angle of the helical thread 3 to the longitudinal axis (the thread angle) may be between 20 and 60. The overall length of the pile 1 may be 3 to 4 meters, though shorter piles 1 of say 1 meter length or piles 1 having a length greater than 4 meters may be provided.

The table below sets out examples of thread (fin) angles to the longitudinal axis for particular outside diameters d and pitches for examples of a pile 1.

| Outside Diameter | Pitch (mm): | | | | | | | | |
|---|---|---|---|---|---|---|---|---|---|
| (d, mm) | 100 | 150 | 200 | 250 | 300 | 350 | 400 | 450 | 500 |
| 25 | 37° | 27° | 21° | 17° | 14° | 13° | 11° | 10° | 9° |
| 50 | 57° | 45° | 38° | 31° | 27° | 24° | 22° | 19° | 17° |
| 75 | 66° | 57° | 49° | 43° | 37° | 34° | 31° | 28° | 25° |
| 100 | 72° | 64° | 57° | 51° | 46° | 42° | 38° | 35° | 32° |
| 125 | 75° | 68° | 63° | 57° | 52° | 48° | 44° | 41° | 38° |
| 150 | 78° | 72° | 67° | 62° | 57° | 53° | 50° | 46° | 43° |

Figure 5:
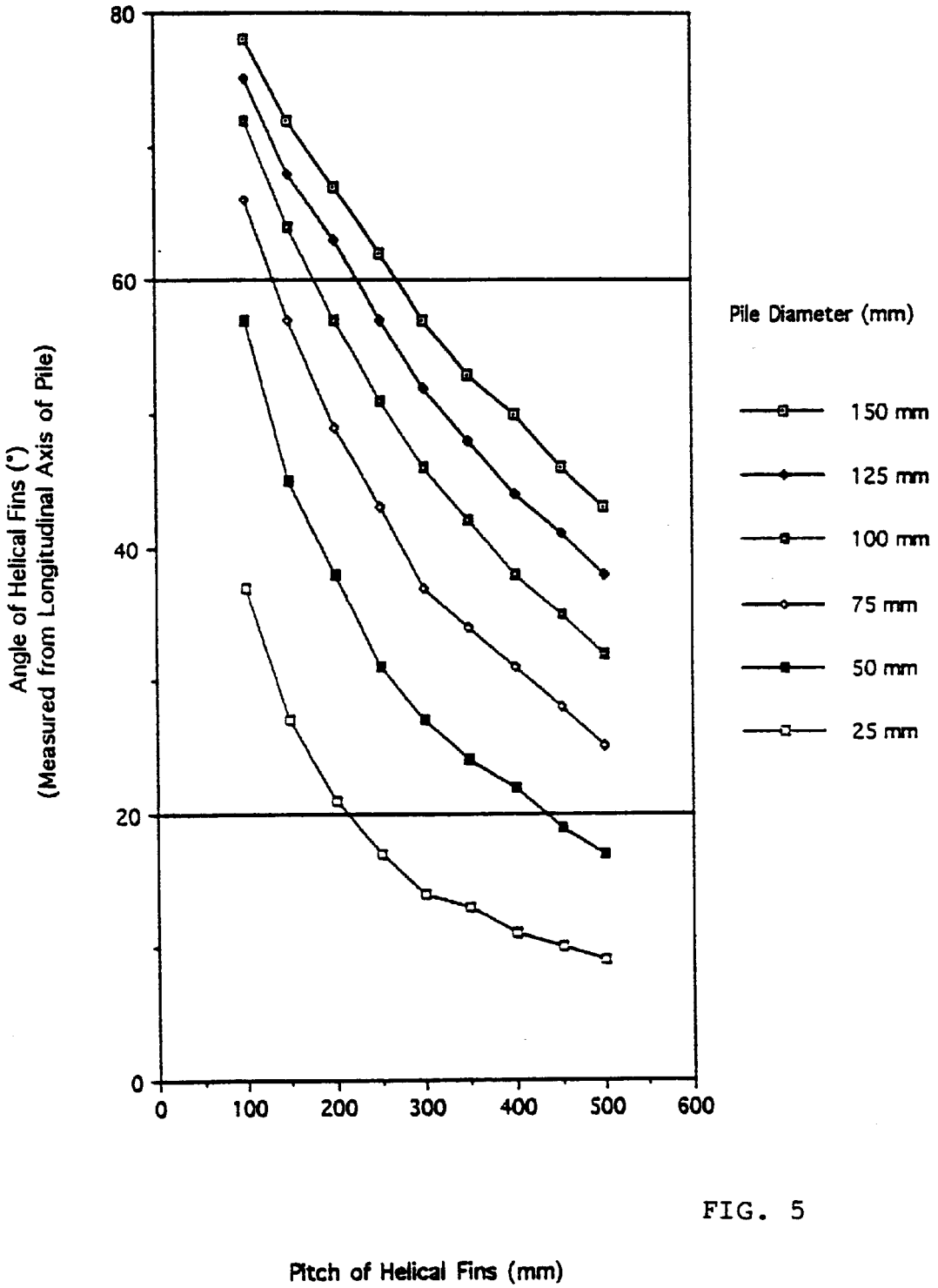
FIG. 5 is a graph showing variation of thread angle with pitch for a range of pile diameters.

This variation of thread angle with pitch for a range of pile diameters is illustrated graphically in FIG. 5.

It will be appreciated that the dimensions given above are examples only. Dimensions between the discrete examples mentioned above also fall within the scope of the present invention. Dimensions beyond those mentioned above are also possible within the scope of the present invention.

In order to fix the pile 1 into a substrate, it is convenient for a pilot hole to be punched, drilled, cored or otherwise formed in the substrate. An upper portion of the pilot hole may be relieved (i.e. made larger) if required in order to facilitate driving of the pile 1 into the substrate.

The pile 1 of the present invention is then driven into the substrate by placing a (possibly relatively sharp) tip of the pile 1 into the mouth of the pilot hole. The pile 1 is then struck with a force which acts substantially parallel to the longitudinal axis 2. It should be noted that substantially no torque is applied to the pile 1 by the driver. On the contrary, the pile 1 screws itself into the substrate by virtue of the helical thread 3 acting against the substrate as the force is applied parallel to the longitudinal axis 2.

The driving force can be applied by any known method, such as manually striking the pile 1, or by using a power-assisted hammer such as a hydraulic or pneumatic hammer. The driving force may be applied as a series of short blows or impulses to the pile 1.

A portion of the pile 1 may be allowed to protrude from the substrate. That protruding end can be used to fix the pile 1 against rotation in order to prevent the pile 1 from rotating further when a vertical load is applied. For example, the pile 1 can have its protruding end fixed in concrete. If the fins 30,31,32 run along the whole length of the pile 1, the fins 30,31,32 provide a useful key for the concrete. Otherwise, if the fins 30,31,32 do not run along the whole length of the pile 1, a rod or some other locking mechanism can be used to fix the pile 1 against rotation, optionally in conjunction with concrete.

The pile 1 can be formed as a series of short sections of say one meter length. Such short sections can then be fixed together to provide a long pile by, for example, drilling and tapping the ends of the sections and connecting the sections with stainless steel studding. Alignment of the sections can be achieved by means of a thin split washer introduced as a spacer between adjacent sections. Use of short sections is particularly useful when working in confined spaces. A first section of the pile 1 can be driven into the substrate as described above. A second short section of pile 1 is connected to the first section. Such connection may be by a connector piece which can be screwed into the adjacent ends of the respective sections of the pile 1. Alternatively, a portion of the core 4 of one end of a section may be recessed whilst the other end of the core 4 of that section may protrude so that adjacent sections can be connected by fitting the protruding portion of the core 4 of one section into the recess of the core 4 of the adjacent section.

Figure 6B:
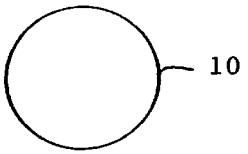
FIG. 6A and FIG. 6B are respectively a side elevation and an end view of a first type of conventional pile.
Figure 6A:
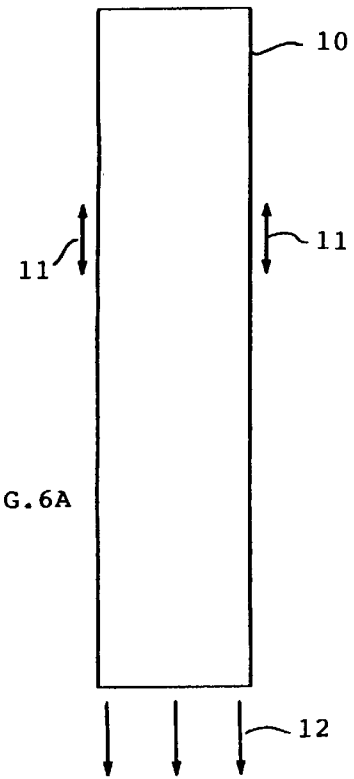

FIGS. 6A and 6B show a side elevation and an end view of a first type of conventional pile 10, the pile 10 of this type being a plain cylinder. In this type of prior art pile 10, frictional forces 11 between the surface of the pile 10 and the substrate in which the pile 10 is situated serve to transmit load (i.e. the downwards forces due to weight being applied to the pile 10) and heave (i.e. those upwards forces due to movement of the substrate, particularly in the uppermost meter or so of the substrate) to the substrate. Load forces 12 are also often transmitted to the substrate by the lower portion of the pile 10 acting as an end bearing and which may abut a rigid object such as a rock. In order to help the pile 10 resist heave, as mentioned above, the uppermost portion of this type of conventional pile is often surrounded by a sleeve, increasing the installation time and costs.

Figure 7B:
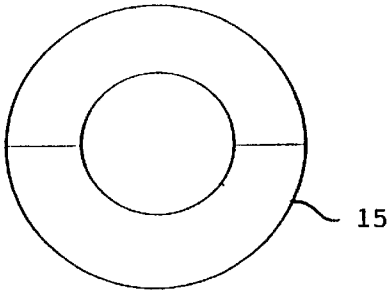
FIG. 7A and FIG. 7B are respectively a side elevation and an end view of a second type of conventional pile.
Figure 7A:
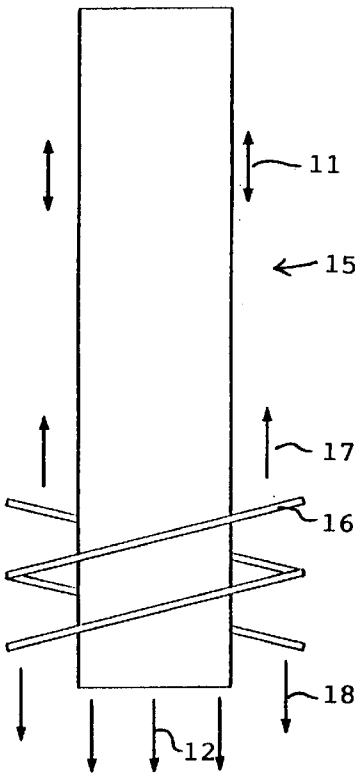

FIGS. 7A and 7B show a side elevation and an end view of a second type of conventional pile 15, the pile 15 of this type being a plain cylinder with a screw thread 16 at its lowermost portion only. Again, frictional forces 11 between the surface of the pile 15 and the substrate in which the pile 15 is situated serve to transmit load and heave to the substrate. Load forces 12 can again be transmitted to the substrate by the lowermost end of the pile 15. The screw thread 16 provides forces 17 which help resist heave and further end bearing forces 18 which assist in transferring load to the substrate. A problem with this type of pile 15 is that when the pile 15 is screwed into the ground, the screw thread 16 tends to loosen the substrate such as soil or clay as it passes through it and thus frictional forces 11 acting between the surface of the pile 15 and the substrate above the screw thread 16 are reduced.

Figure 8B:
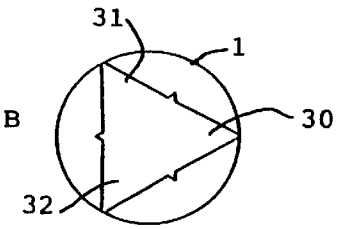
FIG. 8A and FIG. 8B are respectively a side elevation and an end view of an example of a pile according to the present invention; and, FIG. 9 is a schematic side elevation of a pile according to the present invention for explaining the forces acting on the pile.
Figure 8A:
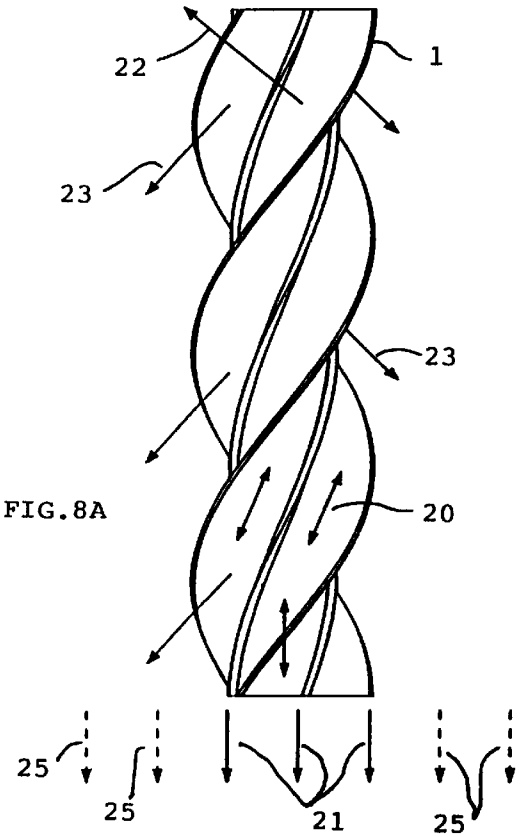
Figure 9:
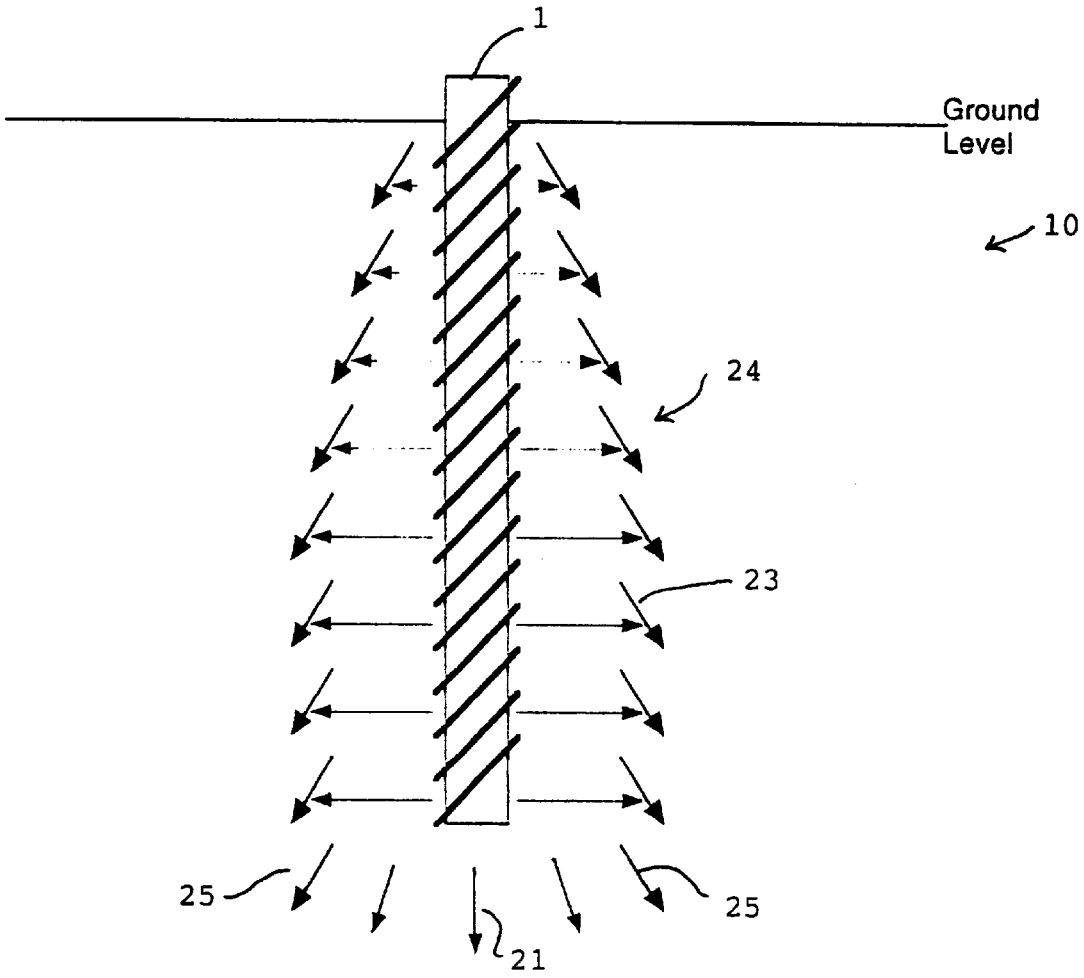

FIGS. 8A and 8B show a side elevation and an end view of a pile 1 in accordance with the present invention. FIG. 9 also shows schematically a pile 1 in accordance with the present invention fixed in the ground 10. Frictional forces 20 act between the surface of the pile 1 and the substrate to enable the pile 1 to resist heave and carry load; in the example shown, the frictional forces 20 act mainly between the surfaces of the fins 30,31,32 and the substrate. End bearing forces 21 also act to enable the pile 1 to carry load. The pile 1 of the present invention also gives rise to further forces which resist heave and carry load. In particular, the helical wedge-shape fins 30,31,32 provide upwards reaction forces 22 and downwards reaction forces 23, depending on the direction of forces applied to the pile, which act in a direction perpendicular to the respective surfaces of the fins 30,31,32.

These reaction forces 22,23 are an important benefit of the present invention for several reasons. First, the reaction forces 22,23 serve to compress the substrate adjacent the pile 1. This in turn increases the frictional forces 20 which act in a direction perpendicular to the respective reaction forces 22,23. Secondly, as shown particularly in FIG. 9 for the reaction forces 23 with a downwards acting component, a large cone of influence 24 is created around the pile 1, mainly because of the compression of the substrate by the action of the reaction forces 23 which spread out into the substrate. This cone of influence leads to an increase in the effective area of the pile 1 of the present invention and the wedge-shape fins 30,31,32 serve to throw the cone out to fill a large volume around the pile 1. In particular, end bearing forces 25 act beyond the actual diameter of the pile 1 to increase the load bearing ability of the pile 1 to match that of a conventional pile of much greater diameter. The same considerations apply to forces acting in an upwards direction on the pile 1 as caused by heave for example. Thus, the pile 1 of the present invention can be much smaller than conventional piles and yet provide the same or better load and heave bearing capabilities.

The provision of the fins 30,31,32 along substantially the whole length of the pile 1 (i.e. at least along the load-bearing portion which is buried in the substrate) also increases the ability of the pile 1 of the present invention to resist heave. This is because heave tends to occur due to movement of the top meter or so of soil only, largely due to wetting and drying of the upper part of the soil. Movement of the top layer of soil will act on the top portions of the fins 30,31,32 and thereby tend to rotate the pile 1 because of the helical shape of the fins 30,31,32. However, the direction of rotation caused by the upwards movement of upper part of the soil acting on the fins 30,31,32 is the direction of rotation which tends to drive the pile 1 further into the ground. The pile 1 of the present invention is therefore better able to resist heave than prior art piles and also does not require a sleeve to help resist heave.

In addition to the improved functionality of the pile 1 of the present invention compared to prior art piles, the pile 1 of the present invention has also been designed to be more eye-catching than prior art piles.

The pile of the present invention can be used for the same purpose as a conventional pile. For example, the pile can be used as a supporting pile for new or existing structures such as buildings, for earth anchoring and reinforcing for example on sloping ground, for supporting and strengthening of retaining walls, under water for moorings of boats or buoys, for cable or stay anchors, as a mooring post on land, and for plate anchoring.

An embodiment of the present invention has been described with particular reference to the examples illustrated. However, it will be appreciated that variations and modifications may be made to the examples described within the scope of the present invention.

What is claimed is:

1. A pile, the pile having a plurality of external helical fins along substantially the whole length of the pile, at least one of the fins having a wedge-shape cross-section.

2. A pile according to claim 1, wherein the fins are substantially parallel.

3. A pile according to claim 1, comprising three external helical fins along substantially the whole length of the pile.

4. A pile according to claim 1, wherein the fins are substantially identical.

5. A pile according to claim 1, wherein the pitch of each fin is in the range 100 mm to 500 mm.

6. A pile according to claim 1, wherein the height of each fin is in the range 10 mm to 50 mm.

7. A pile according to claim 1, wherein the outside diameter of the pile is in the range 25 mm to 150 mm.

8. A pile according to claim 1, wherein each fin is hollow.

9. A pile according to claim 1, wherein each fin is solid.

10. A pile according to claim 1, wherein the pile is hollow.

11. A pile according to claim 1, wherein the pile is solid.

12. A pile according to claim 1 wherein each fin has a substantially triangular cross-section.

13. A pile according to claim 1 wherein each fin includes a pair of opposed sides and said sides define an angle therebetween of between 15 and 75 degrees.

14. A method of driving a pile, comprising:

applying a force to the pile substantially parallel to the longitudinal axis of the pile, said force having substantially no rotational component about the longitudinal axis, wherein the pile has a plurality of external helical fins along substantially the whole length of the pile and at least one of the fins has a wedge-shape cross-section, such that said at least one helical fin on said pile causes said pile to rotate in a substrate and thereby penetrate the substrate as said force is applied.

15. A method according to claim 14, wherein the force is applied repeatedly as a series of impulses to the pile.

16. A method according to claim 14, wherein a pilot hole is formed in the substrate prior to driving the pile into the substrate.

17. A method according to claim 14, wherein an end of the pile is allowed to protrude from the substrate after driving of the pile is complete, the method including the further step of fixing the protruding end against rotation relative to the substrate.

18. A method according to claim 14, wherein the pile is provided as plural sections.

19. A method according to claim 18, comprising the step of driving a first section into the substrate, connecting a second section thereto, and then applying a force to the second section to drive said connected sections into the substrate.

* * * * *

UNITED STATES PATENT AND TRADEMARK OFFICE

CERTIFICATE OF CORRECTION

PATENT NO. : 6,264,403 B1
DATED : July 24, 2001
INVENTOR(S) : Robert S. Hall et al.

It is certified that error appears in the above-identified patent and that said Letters Patent is hereby corrected as shown below:

Title page,
Item [63], -- This application is continuation application no. PCT/GB98/00082, Jan. 12, 1998 --.

Signed and Sealed this

Twenty-eighth Day of January, 2003

JAMES E. ROGAN
*Director of the United States Patent and Trademark Office*